United States Patent [19]

De Nood

[11] Patent Number: 4,940,968

[45] Date of Patent: Jul. 10, 1990

[54] ANTI-THEFT TAG WITH CONICAL COIL

[75] Inventor: Cornelis S. A. De Nood, Harderwijk, Netherlands

[73] Assignee: ID Systems International B.V., Zwolle, Netherlands

[21] Appl. No.: 311,123

[22] Filed: Feb. 14, 1989

[30] Foreign Application Priority Data

Feb. 15, 1988 [NL] Netherlands ..... 8800367

[51] Int. Cl.[5] ..... G08B 13/24

[52] U.S. Cl. ..... 340/572; 340/693

[58] Field of Search ..... 340/572, 693

[56] References Cited

U.S. PATENT DOCUMENTS

| | | | |
|---|---|---|---|
| 4,187,509 | 2/1980 | Weiner | 340/572 |
| 4,590,461 | 5/1986 | Cooper | 340/572 |
| 4,751,500 | 6/1988 | Minasu et al. | 340/572 |

*Primary Examiner*—Glen R. Swann, III

*Attorney, Agent, or Firm*—Webb, Burden, Ziesenheim & Webb

[57] ABSTRACT

An anti-theft tag includes two dishes (3, 4) fixed to each other. One dish (4) is provided with a feed-through hole (15) for inserting a pin (10) with a head (29). The dishes define an internal space for accomodating a releasable lock for locking the inserted pin and a circuit composed of a coil (22) and a capacitor (23). Said coil is conical and its base runs substantially parallel to the faces of the dishes.

6 Claims, 2 Drawing Sheets

ANTI-THEFT TAG WITH CONICAL COIL

BACKGROUND OF THE INVENTION

The invention relates to an anti-theft tag, having dishes which are fixed to each other, and one of which is provided with a feed-through hole for feeding through a pin with a head, said dishes bounding an internal space in which an unlockable lock for locking the fed-through pin and a circuit made up of a coil and a capacitor is accommodated.

Such a tag is generally known and is used, inter alia, for preventing theft in shops. For this, a radio frequency field is generated at the exit of the shop.

The tag can be attached to a garment by holding the dish with feed-through hole against the garment and inserting the pin from the inside of the garment through the fabric thereof and the above-mentioned hole into the tag as far as possible. In this position the pin is locked.

If a thief with a garment provided with the tag passes through the exit of the shop, the circuit tuned to the radio frequency field is excited. The change thereby produced can be detected. In general, an alarm is switched on upon detection of the tag.

The coil of the tuned circuit is wound flat, in order to keep the tag as thin as possible, so that it causes as little nuisance as possible.

The disadvantage of the known tag is that as a result of the flat design of the coil, this tag is not detected if the face of the coil is held in the direction of the radio frequency field when the person is passing through the exit of the shop.

SUMMARY OF THE INVENTION

The object of the invention is to provide a tag of the type mentioned in the preamble, in which the above-mentioned disadvantage is avoided.

This object is achieved according to the invention in that the coil of the circuit is conical and the base of the cone runs substantially parallel to the faces of the dishes.

It has been found that with this shape there is no position of the tag in which detection does not take place.

It has also been found that the greater the area of the opening of the coil, the more powerful is the resonance. Because of the conical shape of the coil, the area of the opening thereof is greater with the same outer periphery of the coil than in a flat-wound coil. It is thus possible still to achieve a powerful resonance with a relatively small tag.

DESCRIPTION OF THE DRAWINGS

The invention will be explained in greater detail below with reference to the drawings. In the drawings.

DETAILED DESCRIPTION OF THE INVENTION

Figure 1:
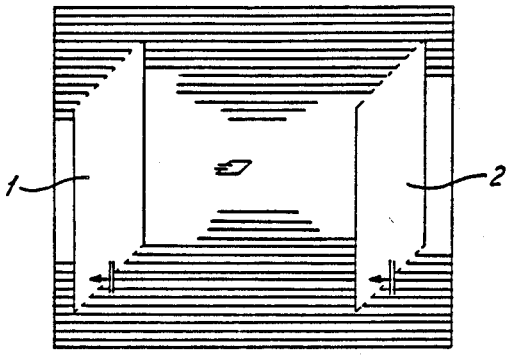
FIG. 1 shows schematically the radio frequency field.
Figure 2:
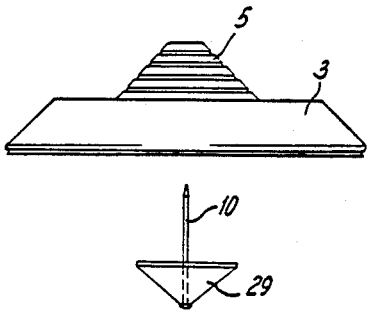
FIG. 2 shows a side view of the tag.
Figure 3:
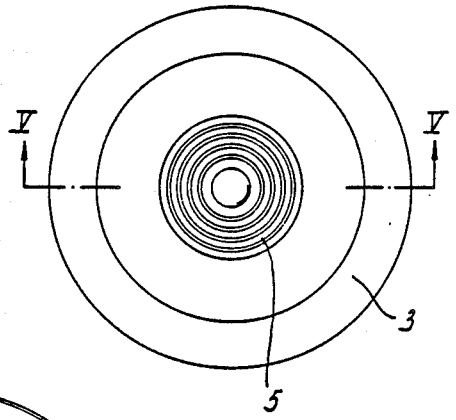
FIG. 3 shows a top view of the tag.
Figure 4:
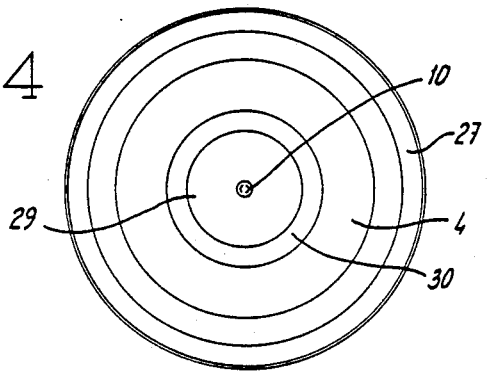
FIG. 4 shows a bottom vieww of the tag.

At the exit of the shop a radio frequency field is generated by means of an aerial coil 1 and a detection coil 2, which are shown schematically in FIG. 1. The direction of the radio frequency field is also shown schematically in FIG. 1.

The anti-theft tag comprises a top dish 3 and a bottom dish 4. The tag has a circular periphery, but other shapes are also possible. The edge of the top dish 3 slots over the edge of the bottom dish 4, where the dishes are attached to each other by fusion welding.

The top dish 3 is provided with a protuberance 5 to create a space to accommodate an unlockable lock. The lock comprises a housing with the housing parts 6 and 7, which preferably slot into each other. The housing contains a number of balls 8, preferably three. The balls lie on one side against the tapering wall 9 of the bottom housing part 7 and on the other side against the inserted pin 10. When the pin is not inserted in the tag, the balls 8 lie against each other or at a distance from each other which is smaller than the diameter of the pin 10. Provision is made above the balls 8 for a pressure element 11, which is biased by the spring 12 in the direction of the balls. For this purpose, one end of the spring 12 rests against a collar 13 of the pressure element 11, while the other end of the spring 12 rests against the top inner wall of the housing part 6.

For easy insertion of the pin 10 through the feed-through hole 15 of the bottom dish 4, the pin is provided with a point 14, which during insertion of the pin tries to push the balls apart, so that they roll upwards along the tapering wall 9.

The dishes 3 and 4 with their respective walls 16, 17, 18 at one side and the walls 19, 20 and 21 at the other side bound an annular space in which a coil 22 is fitted. The slanting walls 18 and 21 of the respective dishes 3 and 4 bound a space in which the conical coil 22 fits, said coil being connected to a capacitor 23 to form an electric circuit. This circuit is tuned to the frequency of the radio frequency field.

The tag is assembled as follows. First, the housing part 9 and the coil 22 are placed on the dish 4, and the balls 8 are inserted in the housing part 9. The pressure element 13 and on it the spring 12 are placed above the balls, and the housing part 6 is fitted over that. The dish 3 is then placed over the assembly thus formed, following which the edges 24 and 25 of the dishes 3, 4 are fixed to each other, preferably by fusion welding.

The inside edge 26 of the dish 3 is perpendicular to the bottom face 27 of the dish 4, while the outside edge 28 of the dish 4 slants inwards. It has been found that with this design the finished fusion weld is hardly visible, so that a thief cannot push a sharp object between the edges of the dishes to prise them apart.

When the tag is being attached to a garment, the bottom dish 4 is held against the fabric of the garment, following which the pin 10 is pushed through the fabric of the garment and through the feed-through hole 15 of the dish 4 into the tag, until the fabric is held between the head 29 of the pin 10 and the bottom face of the dish 4. In this position the balls are pressed by the pressure element 11 and the spring 12 against the pin 10, so that the pin 10 can no longer be removed from the tag. When a purchaser has paid for the garment, the tag has to be removed from the garment, and this is achieved with a magnet which draws the pressure element 11 and the balls upwards, thereby releasing the pin so that it can be removed from the tag. The tag can subsequently be used for another garment.

If a thief attempts to pass through the exit of the shop with a garment bearing the tag, a change in the field is detected by the detection coil 2 and the detection circuit (not shown) connected thereto. The change is produced by the electric circuit, comprising the coil and capacitor, which is tuned to the frequency of the radio frequency field. It has surprisingly been found that, due to the conical shape of the coil, no position of the tag in which detection is not possible can be found. If the coil were to be made flat, there are various positions in which the tag can be moved through the radio frequency field without being detected.

It has also been found that the greater the area of the opening of the coil, the stronger is the resonance. Because of the conical shape of the coil, the area of its opening is greater, with the same outer periphery of the coil, than in a flat-wound coil with the same number of windings. The conical shape thus makes it possible with a relatively small coil, and thus small tag, still to achieve a strong resonance.

Figure 5:
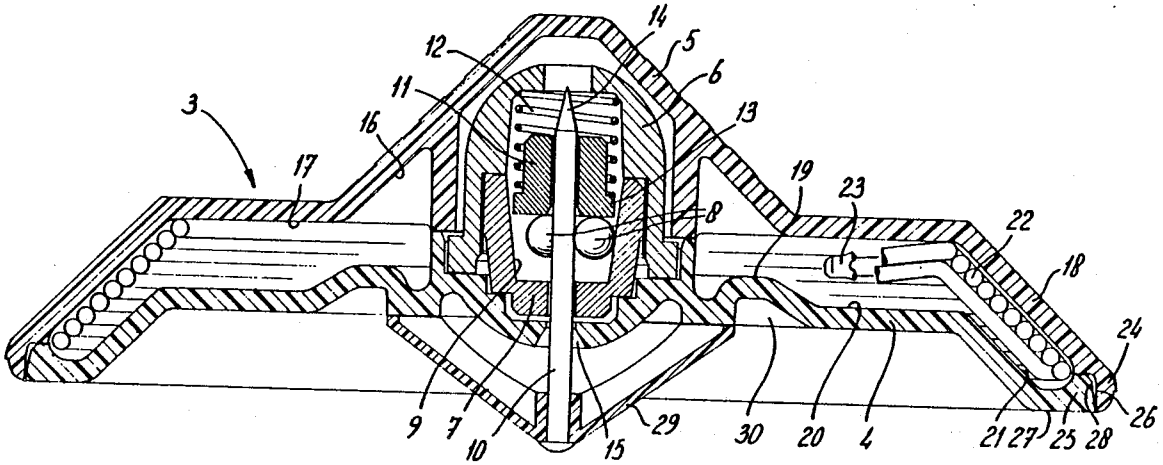
FIG. 5 shows a cross section of the tag along the line V—V in FIG. 3.

FIG. 5 shows that the peripheral edge of the dish 4 provided with the feed-through hole 15 projects outwards beyond the dish face. If a thief tries to press cutting pliers or a sharp object between the head 29 of the pin 10 and the dish 4, the projecting peripheral edge means that the cutting pliers are at an angle. This makes it difficult to insert the jaws of the cutting pliers. The projecting peripheral edge has the further advantage that the tag is thereby pressed flat against the fabric of the garment, which is aesthetically better than the known tags hanging at an angle.

The bottom dish 4 of the tag is also provided with an annular recess 30, the inner wall of which adjoins the outer edge of the head 29 of the pin 10. This inner wall is preferably at right angles to the outer face of the dish 4, while the outer wall of the recess 30 forms an obtuse angle with the bottom thereof. Through the special shape of the recess, insertion of the jaws of the cutting pliers between the head 29 of the pin and the outer face of the dish 4 is made even more difficult.

I claim:

1. Anti-theft tag, comprising dishes which are fixed to each other, and one of which is provided with a feed-through hole for feeding through a pin with a head, said dishes having faces bounding an internal space in which an unlockable lock for locking the fed-through pin and a circuit made up of a coil and a capacitor is accommodated, in which the coil of the circuit is conical and the base of the cone runs substantially parallel to the faces of the dishes.

2. Tag according to claim 1, in which the peripheral edge of the dish provided with the feed-through hole is outwardly higher than the face of the dish.

3. Tag according to claim 2, in which the outer face of the dish provided with the feed-through hole has a recess adjacent to the outside edge of the head of the pin.

4. Tag according to claim 3, in which the wall of the recess closest to the pin head periphery runs at right angles to the face of the dish.

5. Tag according to claim 3 or 4, in which the wall of the recess furthest away from the pin head periphery forms an obtuse angle with the bottom of the dish.

6. Tag according to claim 1, in which at the periphery of the tag one dish slots over the peripheral face of the other, and the peripheral face of the latter dish runs inwards at an angle to the dish face.

* * * * *